US012428912B2

(12) United States Patent
Orndorff et al.

(10) Patent No.: US 12,428,912 B2
(45) Date of Patent: Sep. 30, 2025

(54) STEERING HEAD FOR PIPE RAMMING/HAMMER BORING INSTALLATIONS

(71) Applicant: PLG Technologies, Inc., Bakersfield, CA (US)

(72) Inventors: Aaron Orndorff, Bakersfield, CA (US); Brian Sherrell, Bakersfield, CA (US)

(73) Assignee: PLG Technologies, Inc., Bakersfield, CA (US)

( * ) Notice: Subject to any disclaimer, the term of this patent is extended or adjusted under 35 U.S.C. 154(b) by 0 days.

(21) Appl. No.: 18/766,550

(22) Filed: Jul. 8, 2024

(65) Prior Publication Data

US 2025/0012150 A1 Jan. 9, 2025

Related U.S. Application Data

(60) Provisional application No. 63/525,437, filed on Jul. 7, 2023.

(51) Int. Cl.
*E21B 7/06* (2006.01)

(52) U.S. Cl.
CPC ..... *E21B 7/062* (2013.01)

(58) Field of Classification Search
CPC ..... E21B 7/062
USPC ..... 175/73
See application file for complete search history.

(56) References Cited

U.S. PATENT DOCUMENTS

| | | | | |
|---|---|---|---|---|
| 3,637,032 | A | 1/1972 | Jeter | |
| 3,767,836 | A * | 10/1973 | Geis | E21B 7/201 175/173 |
| 3,857,449 | A * | 12/1974 | Kimura | E21D 9/005 175/45 |
| 5,054,565 | A * | 10/1991 | Kinnan | E21B 7/18 175/73 |
| 9,506,344 | B2 | 11/2016 | Harrison et al. | |
| 10,047,562 | B1 * | 8/2018 | Cherrington | E21B 21/12 |
| 2010/0206635 | A1 | 8/2010 | Harrison et al. | |
| 2014/0219725 | A1 * | 8/2014 | Harrison | E21B 7/067 405/138 |
| 2020/0182020 | A1 * | 6/2020 | Evans | E21B 23/04 |

* cited by examiner

*Primary Examiner* — Taras P Bemko
(74) *Attorney, Agent, or Firm* — James M. Duncan; Young Wooldridge LLP

(57) ABSTRACT

A steering head for a pipe ramming hammer bore construction system, configured to allows passage of soil through the center of the steering head while maintaining the ability to change the bore alignment through the use of inflatable bags which are underlying and adjacent to a portion of a shell member which extends radially outward from the steering head upon inflation of the inflatable bag. The inflatable bags may be inflated by inflation media supply lines which extend from the bore pit to the steering head and deflated by release of the inflation media. The media flow to the inflatable bags may be controlled by media valves which may be located in the steering head or, alternatively, at a different location, such as in the bore pit. The remote nature of the system eliminates the need for frequent removal of the pneumatic hammer, confined space entry, and manual corrections performed inside the casing.

17 Claims, 8 Drawing Sheets

STEERING HEAD FOR PIPE RAMMING/HAMMER BORING INSTALLATIONS

BACKGROUND OF THE INVENTION

The present invention generally relates to pipe ramming (also known as hammer boring) utilized in trenchless construction operations. As opposed to open cut construction, in trenchless construction line-of-sight locating of the boring or trenchless apparatus is a costly and time-consuming process. While trenchless construction methods are, by themselves, more expensive than open cut construction, trenchless construction provides a number of benefits because it avoids a number of costs associated with open cut construction. These costs include pavement removal and replacement, dewatering, surface restoration, right-of-way, or utility acquisition, public inconvenience, lost business revenue arising from road closure or obstruction, reduction of noise and dust, tree removal, etc. In other cases, such as river crossings, lakes, wetlands, etc., trenchless construction provides the only available construction method.

In many cases, the soil type, distance of the required bore, type of utilities to be installed in the casing, and regulations from an authority having jurisdiction over the project will dictate the construction methods of casing installation. Certain types of soil conditions make conventional jack-and-boring, auger boring, or the like, unfeasible. These conditions include flowing sand, marshy/high ground water conditions, and soils comprising unpredictable quantities and sizes of cobbles. In these cases, the method of construction that is generally preferred is a pipe ramming operation.

In the pipe ramming method of horizontal casing installation, a high-volume compressor powers a pneumatic hammer which is placed at the rear of a first section of casing. The pneumatic hammer and its support structure and the first casing section are typically placed in a generally horizontal orientation at the bottom of a bore pit, with the front of the first section of casing facing an earth wall through which the bore will extend. The front of the first section of casing will have a "shoe" which is configured to encounter and penetrate the earth as the pneumatic hammer applies blows at the opposite end of the casing.

Upon application of a high flow rate of high-pressure air to the pneumatic hammer, a steel slug moves back and forth, causing the hammer to strike the rear of the casing at approximately 2-3 cycles per second. This impact slowly drives the casing horizontally through the ground. Once the casing has been driven a certain length into the ground, the pneumatic hammer is removed from the casing and an additional section of casing are welded to the end of the casing in the bore pit. The hammer is placed back in position and the operation continues, with sections of casing added as the bore proceeds. When the leading edge of the casing penetrates through the ground to a receiving pit located at the opposite end of the bore, the hammer is removed from the bore pit and the soil inside the casing is cleared out to complete the installation, with the casing typically cleaned out with a traditional auger or by using compressed air to push a cleaning pig through the casing.

The pipe ramming bore method has certain advantages, including the ability to break apart cobbles from the impact force of the hammer. Without rotating augers disturbing the native soil, there is less chance of a cobble getting into a bind with the cutting head or augers thereby causing damage. In addition, spoils are not actively excavated away from the leading edge of the casing as is done with auger bore installations. This feature results in a substantial dirt plug being maintained inside the casing toward the front. The dirt plug prevents flowing sugar sand and/or muddy/marshy soil from flowing into the casing and creating a void above the casing, which is a major concern for auger bore installations.

Among the disadvantages of the pipe ramming method is its unpredictability. Pipe ramming operations are essentially conducted using a "point and shoot" approach because the known operations provide no ability to steer the bore. As a result, if the casing encounters a large cobble or soil stratification, the bore may be deviated from its intended line and grade. There have been documented cases of such bores surfacing in the middle of active roadways and railroad tracks because the bore took a drastic, upward trajectory. Resolving this unpredictability has typically involved installing a much larger casing than required for the utility. This is especially true for sewer and other gravity fed pipelines that must be installed on a slope. If a casing much larger than required for the intended utility is installed there is less chance that the design grade of the utility will be compromised.

The steering heads known for use in auger bore operations cannot be used with the known pipe ramming systems. The steering heads utilized in auger bore operations typically utilize hydraulically actuated flaps to steer the bore, where the flaps are raised as required to impose a pressure on the surrounding dirt in an attempt to change the vertical and/or horizontal angle of the casing. One reason such steering heads cannot be used is that the hydraulic jacks used to activate the steering flaps require significant space within the tool. Even the lowest profile hydraulic jacks require an annulus restriction in the tool that is unfavorable to pipe ramming. With augers rotating and removing spoils, a smaller annulus between an inner can and outer shell of the tool is acceptable because dirt is conveyed away from the leading edge at a rapid rate. However, with pipe ramming there are no augers to convey the dirt away as the bore progresses.

In the absence of a steering mechanism, if some level of control over line and grade is required, the pneumatic hammer must be disconnected and removed after the installation of twenty to sixty feet of casing. An auger boring machine is then lowered into the bore pit, the dirt within the casing cleaned out, and confined space entry is made by the contractor. Measurements are taken from inside the casing, and if the casing has deviated from its intended line and grade, adjustments are made in an attempt to correct the deviation when the hammer is re-attached. This operation must be repeated every twenty to sixty feet throughout the duration of the bore, and it is a time consuming, costly, and potentially unsafe process.

SUMMARY OF THE INVENTION

A system which provides a steering mechanism for a ramming/hammer boring apparatus is highly desirable. Embodiments of the present invention provide an answer to this need and significantly reduce the need for repeated removal of the hammer assembly from the bore pit, spoil cleanout, and confined space entry which are otherwise required to affect a change in the line and grade of a bore. The present invention is anticipated to be used for casing installations for large diameter conduits, which will typically range from 24 to 60 inches.

The present invention provides a steering head having a casing member which forms a conduit which provides for the smooth passage of dirt through the steering head as the pipe ramming operation progresses. The casing member has an inside diameter, an exterior surface, an interior, a lead end and a tail end, wherein the lead end is configured to be utilized in a boring operation. At least one pocket section is defined on the exterior surface of the casing member. An inflatable bag is disposed within the pocket section. The pocket section is further defined by retaining struts which restrain the inflation bag along the periphery of the bag to focus the force of an inflating bag to an outwardly direction. As described below, embodiments of the steering head will typically have four pocket sections with an inflatable bag disposed within each pocket section.

A shell member is disposed on the casing member such that the shell member overlies each pocket section. Upon an inflation of the inflatable bag, at least a portion of the shell member axially adjacent to an underlying inflatable bag extends radially outward. The radially extending portion of the shell member reacts with the surrounding matrix of the earth thereby affecting a change in direction of the steering head.

Embodiments of the steering head will generally utilize multiple inflatable bags, where each is disposed at a different circumferential position about the casing member (e.g., twelve o'clock, three o'clock, six o'clock, and nine o'clock), wherein each of the inflatable bags may be independently inflated or deflated. This configuration provides the ability to steer the device in a desired direction by inflation or deflation of specific inflatable bags. The inflatable bags may be configured to cycle between an inflated and deflated state, thereby providing a mechanism which provides a steering capability during an entire boring operation. Each of the inflatable bags may selectively receive an inflation media, such as air, through a hose connected to the inflatable bag. When a proper course correction has been made, some or all of the inflation media may be released through the hose to allow deflation of the bag.

The radially extending portions of the shell member may be configured with mechanically distinct structures. First, the radially extending portions may be configured as steering plates which are pivotally attached over windows in the shell member and, upon inflation of an underlying and adjacent inflatable bag, extend radially outwardly to react with the surrounding earth and affect a change in the direction of the device. Alternatively, the shell member may be configured to comprise a plurality of overlapping plate members in which several of the overlapping plate members, upon inflation of an underlying and adjacent inflatable bag, extend radially outwardly into the surrounding earth. In yet another embodiment, the shell member may be configured as a thin-walled deformable plate in which, upon inflation of an underlying and adjacent inflatable bag, a portion of the deformable plate extends radially outwardly into the surrounding earth. The thin-walled deformable plate may be fabricated from carbon steel, alloy metals, composites, synthetics or other materials which may provide the required flexibility and strength. Through the utilization of the above-described radially extending portions of the shell member (whether steering plates, overlapping plate members or deformable plate), corrections to the grade and/or line can be made remotely either from the bore pit or from another remote location by activating control valves which control the flow of a media into and out of each of the inflatable bags.

As an example of the first embodiment of the shell member described above, the shell member may have steering plates disposed over windows in the shell member at 12, 3, 6, and 9 o'clock positions on the shell member, when the head is viewed from the rear. When activated, the 12 o'clock steering plate steers the casing down, decreasing its grade, the 3 o'clock steering plate steers the casing to the left, the 6 o'clock steering plate steers the casing up, increasing its grade, and the 9 o'clock steering plate steers the casing to the right. Alternatively, windows may be placed at other geometries around the steering head in lieu of the 12, 3, 6, and 9 o'clock positions describe above.

The casing member of the invention has a length which may vary in accord with the size of the casing being installed. The outside diameter of the casing member is generally equivalent to the outside diameter of the casing being installed with the bore, with the casing member having increased wall thickness to effectively transmit impact forces longitudinally from the hammer, through the casing, to the leading edge of the steering head. The pocket sections vary in length and width depending on the diameter of the steering head. For embodiments of the device which utilize a shell member having pivotable steering plates, the steering plates may be attached to the shell member with weldable steel bands which are placed at the leading edges of the steering plates (with respect to the direction of bore travel) where the weldable steel straps secure the steering plates in place and provide a hinge point when the steel straps bend as the window is activated by the inflating of the underlying air bag.

The casing member may comprise a rear section, a middle section, and a front section, where the pocket sections are disposed within the middle section, with each pocket section disposed at a different circumferential position of the exterior surface. The middle section has an outside diameter which decreases along the length of the middle section along its length from the lead end to the tail end. This conical configuration provides the space for the pocket sections.

The pocket sections are configured to accommodate inflatable bags which are used to apply an outwardly directed force to a portion of an overlying shell member, thereby causing the portion of the shell member to extend radially outward. The outside diameter of the tail end of the middle section, and the corresponding inner diameter, may be 2-3 inches less than the outside and inside diameters at the lead end. A steel bulkhead is welded to the smaller diameter end of the tail end of the middle section. The steel bulkhead at the trailing edge of the middle section provides structural integrity and transmits impact forces from the pneumatic hammer through the casing member to its leading edge. The steel bulkhead also provides a structure for hose penetrations which allow placement of the hoses utilized for inflation and deflation of the inflatable bags disposed forward of the steel bulkhead. The thickness of the bulkhead may vary based on the steering head diameter. The bulkhead may be further reinforced by gussets which are welded from the inside surface of the outer casing to the bulkhead. The size, spacing, thickness, and quantity of these gussets may vary depending on the steering head size.

The rear section of the steering head may also have hose and instrument penetrations. These penetrations allow for the routing of the hoses along the exterior length of the casing string until the hoses pass through the penetrations in the rear section and pass through the hose penetrations in the bulkhead into the pocket sections. The hose penetrations in the rear section may also be utilized for passage of instrument cabling or for water level discharges from a casing compass mechanism.

A steel band may be welded to the outside diameter of the outer casing at the leading edge. The thickness and length of the band depends on the size of the casing and the type of soil though with the pipe ramming operation is occurring. The band is designed to overcut the soil, thereby reducing friction along the surface of the casing behind the leading edge resulting in an increased efficiency of the pneumatic hammer. The band may also create a small void circumferentially in the earth around the front of the casing, thereby facilitating a change in angular position when a radially extending portions of the shell member is activated by operation of the inflatable bags.

Pressure application to the inflatable bags is accomplished through either manual ball valves or electronic solenoid valves. In the manual valve configuration, each inflatable bag has an independent inflation hose running along the outside of the casing and protected from the surrounding soil by a steel C channel until extending through the hose penetrations in the rear section and passing through the hose penetrations in the bulkhead into the pocket sections as described above. In the electronic solenoid valve configuration, valves may either be located remotely, such as on a skid located inside the bore pit or, alternatively, locally by being mounted within the pocket sections. If installed locally within the pocket sections, each inflatable bag may be controlled individually by one common media supply hose along the top of the casing. For the remotely controlled valves, a power and communication cable may be utilized to control a pneumatic valve bank via a digital communications protocol. The communication cable may also send pressure data back to a controller mounted on a skid. In this configuration, pressure relief valves are installed inside the pocket sections to prevent over pressurization of the inflatable bags.

A skid mounted control module for the steering head will typically be located inside the bore pit. Depending upon the configuration, the control module may be connected to the steering head by a combination of inflation media hoses, power and/or communications cables. The control module may have also control a source of the inflation media, which may include an air compressor and/or a inflation media storage tank to produce the pressurized media for inflation of the inflatable bags. The compressor may be powered by 120 VAC to produce pressurized air to inflate the inflatable bags. The size of the inflation media storage tank may be based on the size of the air bags which, in turn, are determined by the diameter of the steering head. It is to be appreciated that while the inflation media will typically be air, other inflation media may be utilized to inflate the inflatable bags.

In a manual configuration for a device utilizing four inflatable bags, four ball valves may be mounted in parallel on a manifold downstream of an inflation media supply, such as an inflation media storage tank. The ball valves manually control media flow through individual media lines that run along the top of the casing to the steering head to independently control each of the inflatable bags. Pressure gauges may be positioned downstream of the manifold thereby enabling the determination of the applied pressure to each inflatable bag. Each media circuit may also have a pressure relief valve downstream of each ball valve. In the manual configuration, a user can open the ball valves until a desired pressure is reached in the inflatable bags to actuate the radially extending portions of the shell member to achieve the desired line and grade.

In the electronic solenoid valve configuration for a device utilizing four inflatable bags, a four-valve manifold may be mounted either on the skid mounted control module or, alternatively, in the cavity provided in the annulus of the steering head to provide for remote activation of the inflatable bags. The remote activation embodiment has the advantage of requiring fewer air lines that need to be ran along the top of the casing and increases the responsiveness of the bags to pressure application. Within the remote valve bank may be four pressure transducers which transmit pressure data from each air circuit to the control module. Control of the air solenoids and receipt of the feedback loop involving the pressure data is accomplished via a digital data transmission protocol.

The electronic solenoid valve configuration may include an Automation Controller and Human Machine Interface (HMI) which may be located within the control module. The HMI commands the solenoid valves to open and close and receives pressure transducer data. The HMI digitally displays pressures on each of the inflation media circuits as well as digital momentary switches which allow a user to open the solenoid valves to apply pressure to or relieve pressure from each inflation media circuit.

DETAILED DESCRIPTION OF THE EMBODIMENTS

Figure 1:
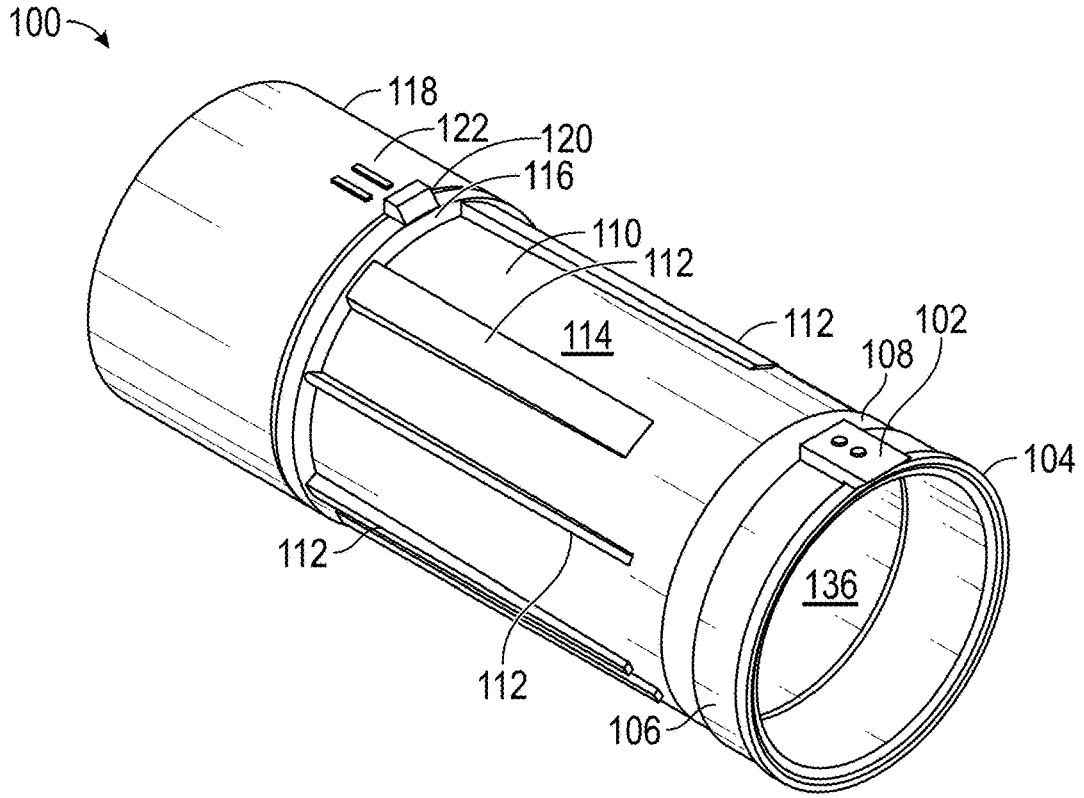
FIG. 1 shows a perspective frontal view of an embodiment of an inner sleeve assembly which may be utilized with all embodiments of the disclosed steering system.
Figure 2:
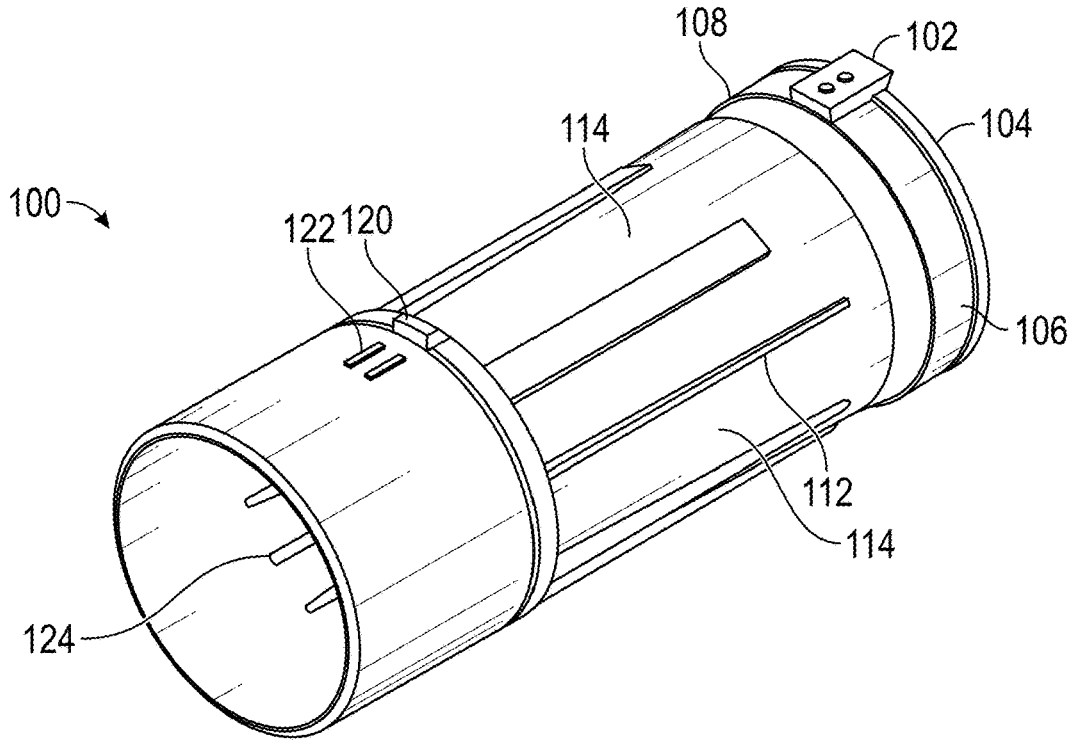
FIG. 2 shows an perspective rear view of an embodiment of the inner sleeve assembly.

Referring now to the figures, FIGS. 1-2 show an embodiment of an inner sleeve assembly 100 which may be utilized with the different embodiments of the disclosed steering system. At lead end 102 inner sleeve assembly 100 may have a front clearance horn which helps to clear a passage through the bore for the media lines and other utilities which will typically run along the top of the casing beneath steel channel. An outer relief band 104 is welded to lead end 102 along with an axially adjacent structural band 106 to provide the required structural integrity required for pipe ramming operations. Outer relief band 104 and structural band 106 form the leading edge of front section 108 ("front can") of the inner sleeve assembly 100, with both the outer relief band and the structural band covering the full circumference of the conduit portion of the inner sleeve assembly. Outer relief band 104 and structural band 106 will typically be fabricated from A36 steel, with outer relief band 104 having a thickness of approximately 0.50 inches and a width of 2.0 inches and structural relief band 106 having a thickness of 0.625 inches and a width of 10.00 inches.

The middle section 110 ("inner structural can") of inner sleeve assembly 100 has a conical configuration with the outside diameter of the pipe adjacent to front section 108 being larger than the outside diameter of the pipe adjacent to bulkhead 116 which separates middle section 110 from rear section 118 ("rear can"). This conical configuration in combination with struts 112 provide for a pocket section 114 to be defined on the exterior surface of the middle section 110. A rear clearance horn 120 is attached at bulkhead 116, where the rear clearance horn helps to clear passage through the bore for the media lines which may be installed in utility penetrations 122.

Figure 3:
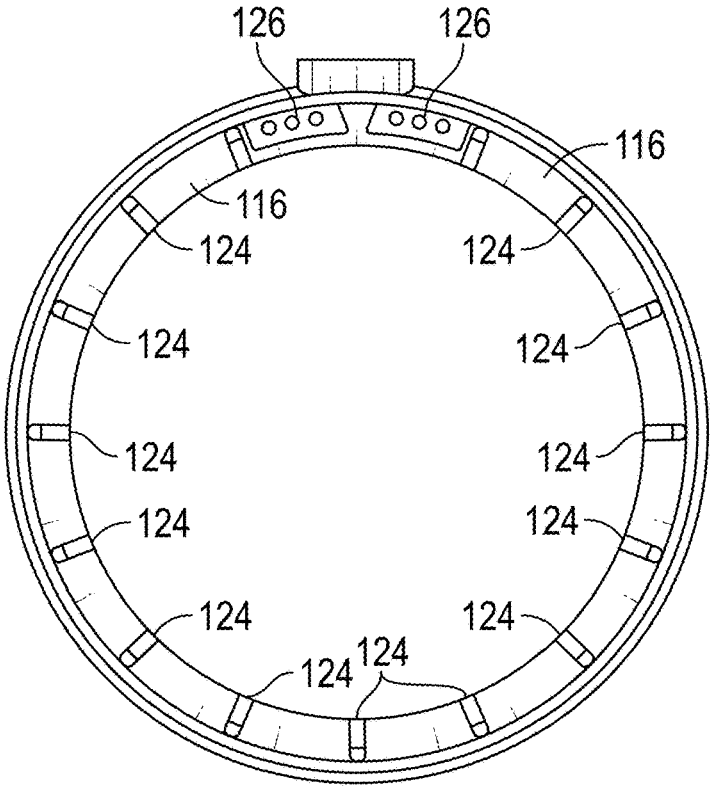
FIG. 3 shows a rear view of an embodiment of the disclosed inner sleeve assembly.
Figure 4:
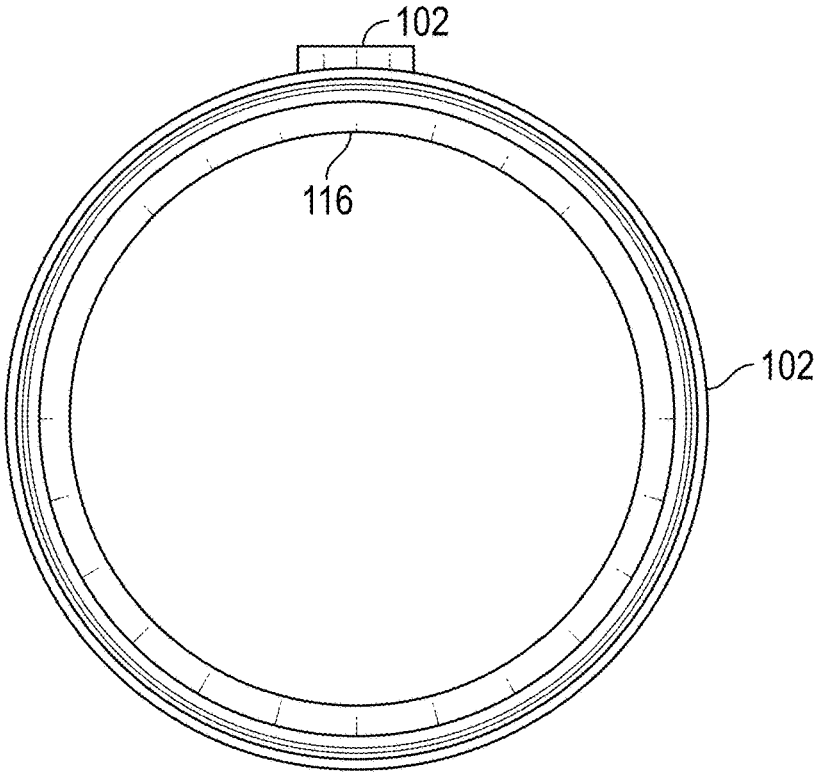
FIG. 4 shows a front view of an embodiment of the disclosed inner sleeve assembly.

FIGS. 3-4 show interior views of inner sleeve assembly 100. Inner sleeve assembly 100 has an inner conical configuration 136 corresponding to the exterior configuration, with the internal diameter at lead end 102 larger than the internal diameter at the bulkhead 116. FIG. 3 shows a rear view of the inner sleeve assembly 100 showing an interior view of rear bulkhead 116. As shown in FIG. 3, the interior of rear section 118 has gussets 124 to provide structural integrity. A total of approximately fifteen gussets 124 may be utilized in providing reinforcement to inner sleeve assembly 100, with the gussets fabricated from 1.0-inch A572 Grade 50 structural steel. As shown in FIG. 3, a plurality of hose penetrations 126 may extend through bulkhead 116. This configuration allows inflation/deflation hoses 130 and other utilities to be run along the top of the exterior of the casing, fed through utility penetrations 122 and fed into the pocket sections 114 through hose penetrations 126.

Figure 5:
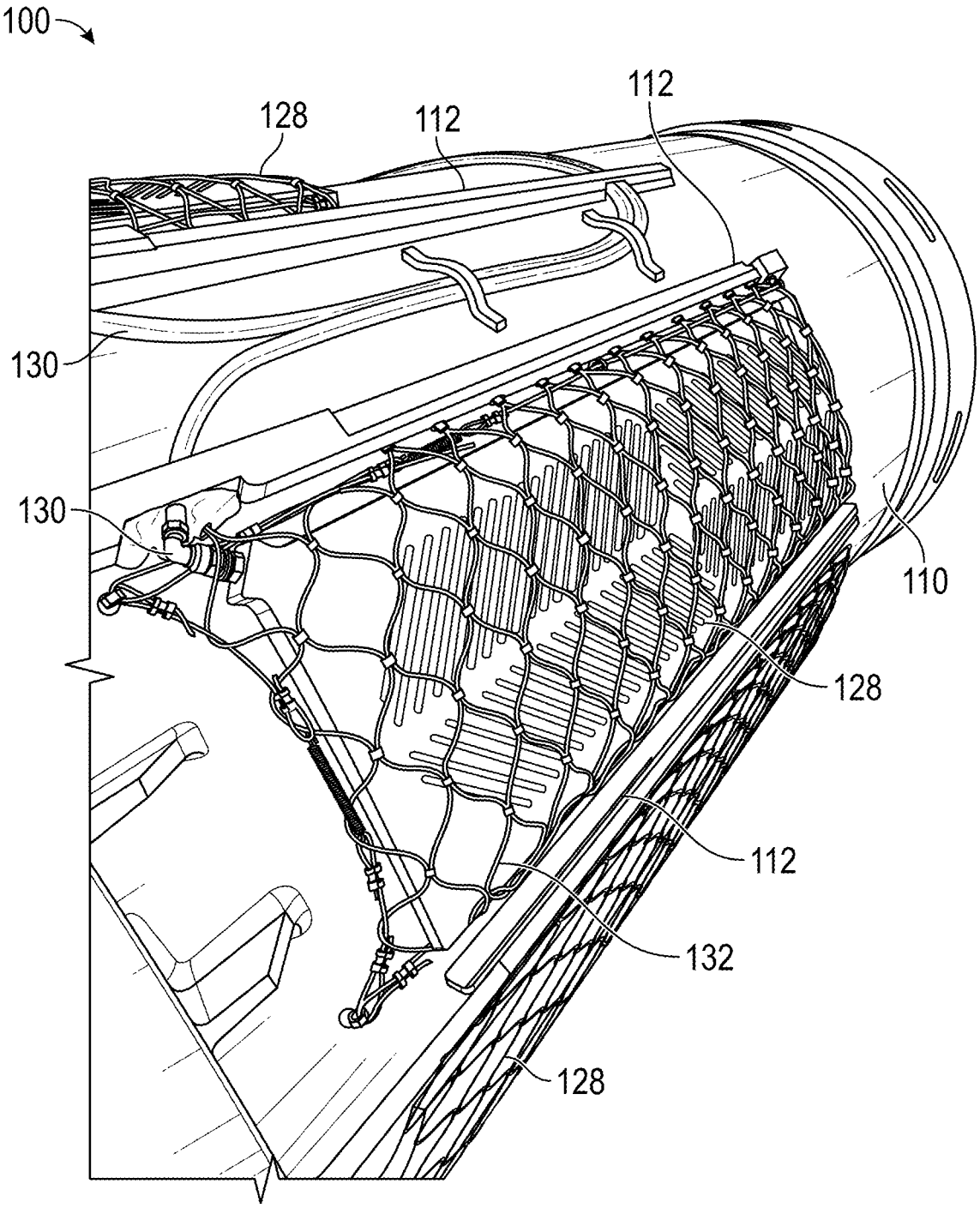
FIG. 5 shows a rear perspective view of an embodiment of the disclosed steering head with air bags but without an exterior steering shell.
Figure 6:
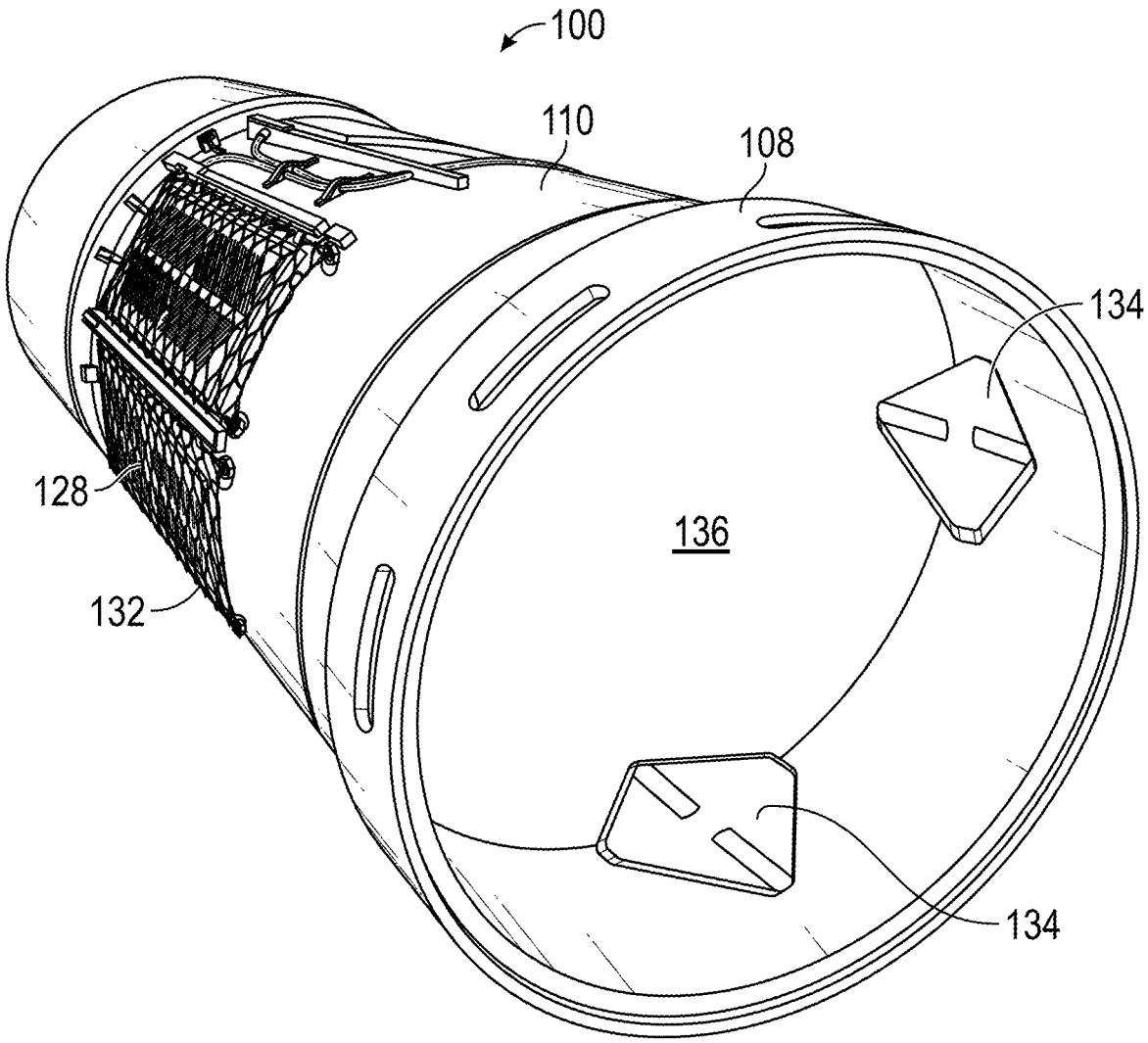
FIG. 6 shows a front perspective view of an embodiment of the disclosed steering head with air bags but without an exterior steering shell.

FIGS. 5-6 show the inner sleeve assembly 100 with inflatable bags 128 placed within the pocket sections 114. A separate Inflation/deflation hose 130 is connected to each of the inflatable bags 128 to provide for selectively inflating or deflating any one of the inflatable bags to affect a turn of the steerable head. It is to be appreciated that the inflation and deflation of the inflatable bags 128 may be accomplished by a single hose 130 controlled by a single valve. Alternatively, the inflatable bag may be inflated with an inflation hose and deflated with an independent deflation hose.

An inflation bag retaining assembly 132 may be utilized to retain the inflatable bags 128 within the pocket sections 114. Inflation bag retaining assembly 132 will be of a flexible material which allows the radially outward expansion of the inflatable bags 128. Struts 112 control lateral expansion of the inflatable bags 128, thereby focusing the expansion of each inflatable bag to be radially outward. FIG. 6 shows a front oblique view of inner sleeve assembly 100 showing the use of front gussets 134 to provide additional structural integrity to the attachment of front section 108 to middle section 110.

Figure 7:
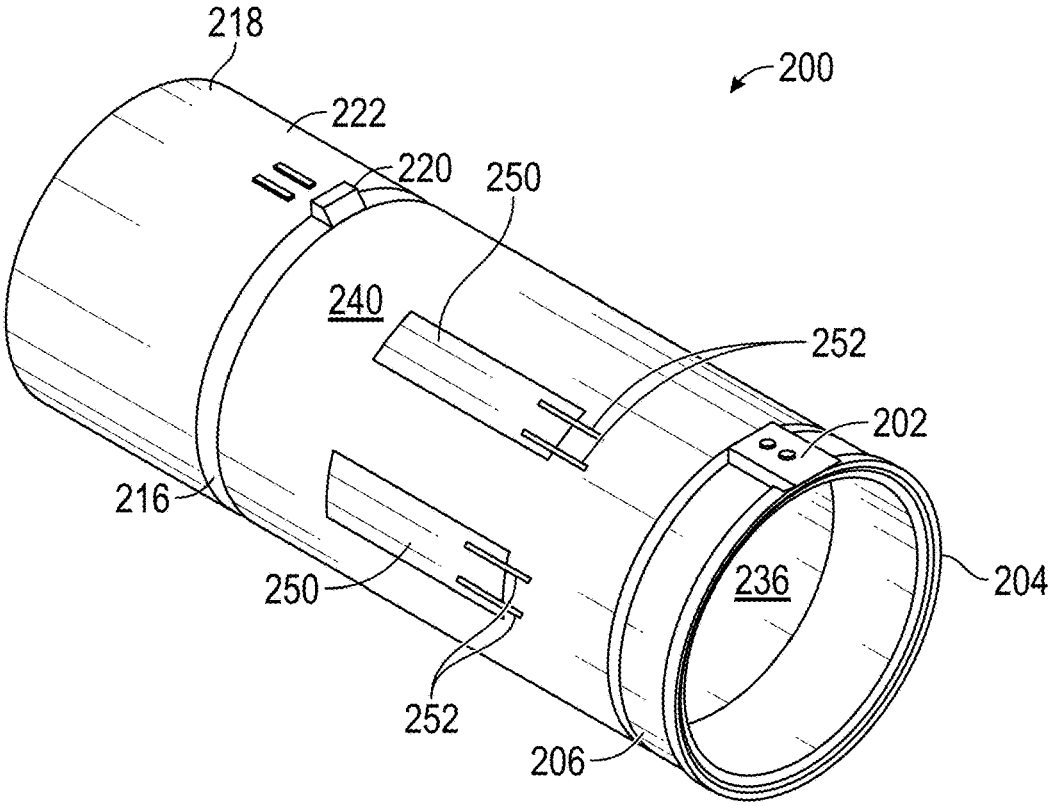
FIG. 7 shows a perspective frontal view of an embodiment of the disclosed steering head equipped with a steering shell with hinged steering plates.
Figure 8:
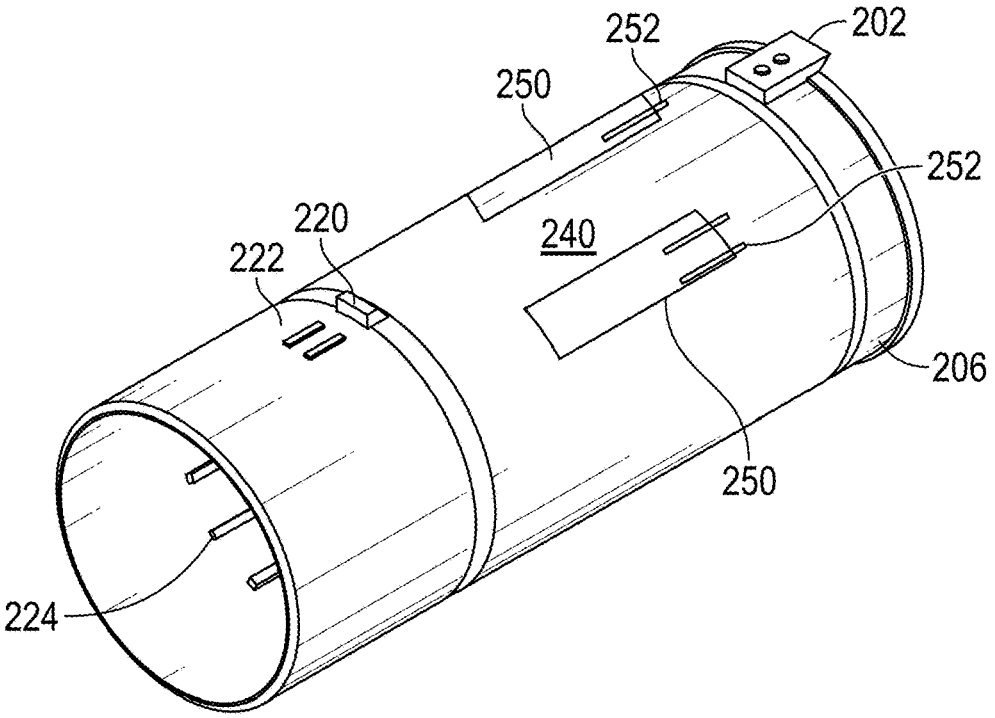
FIG. 8 shows a perspective rear view of an embodiment of the disclosed steering head equipped with a steering shell with hinged steering plates.
Figure 9:
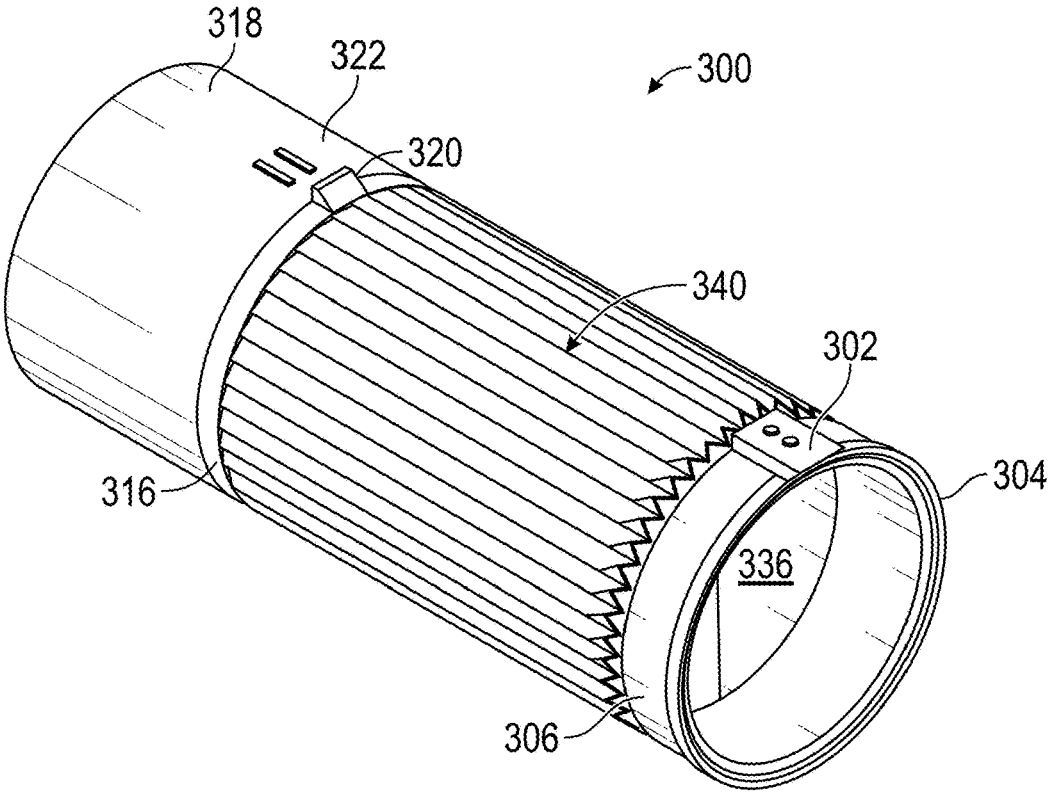
FIG. 9 shows a perspective frontal view of an embodiment of the disclosed steering head equipped with a segmented steering shell.
Figure 10:
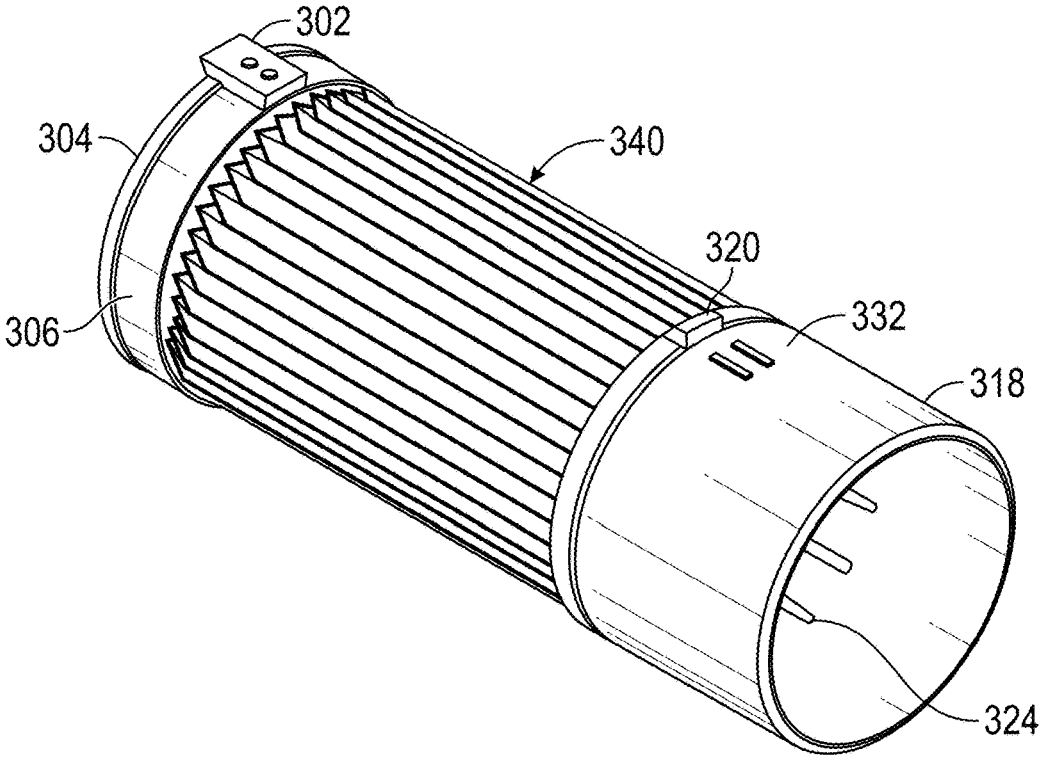
FIG. 10 shows a perspective rear view of an embodiment of the disclosed steering head equipped with a segmented steering shell.
Figure 11:
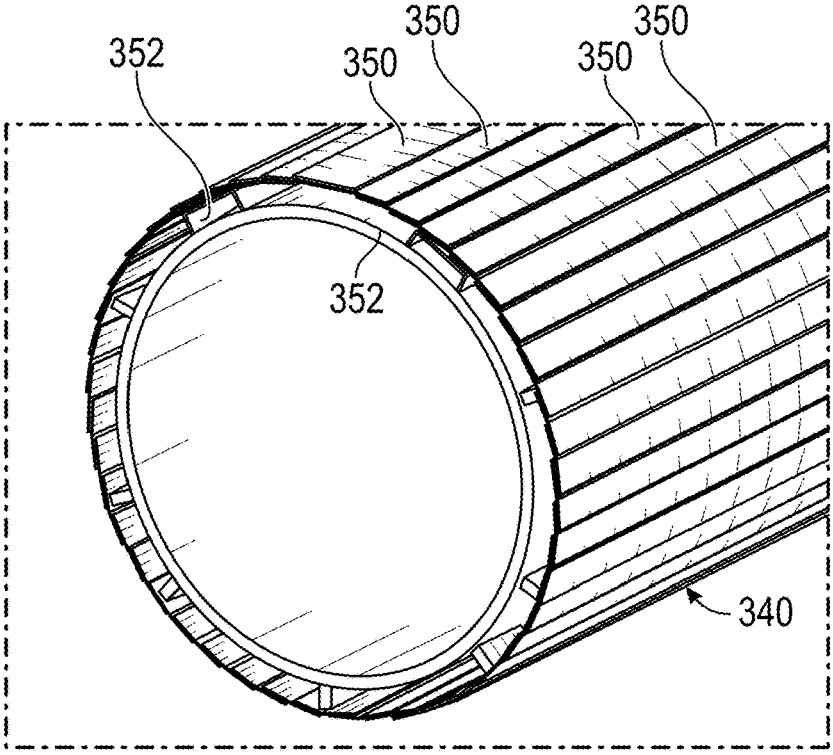
FIG. 11 shows a perspective end view of the segmented steering shell.

FIGS. 7-8 depict the inner sleeve assembly 100 discussed above upon which a steering shell 240 has been disposed upon the middle section 110 resulting in the hinged steering plate embodiment 200. Hinged steering plate embodiment 200 has a lead end 202 which may have a front clearance horn. An outer relief band 204 is welded to lead end 202 along with an axially adjacent structural band 206 to provide the required structural integrity required for pipe ramming operations.

Hinged steering plate embodiment 200 has a bulkhead 216 which separates the steering shell 240 from rear section 218. A rear clearance horn 220 is attached at bulkhead 216, where the rear clearance horn helps to clear passage through the bore for the media lines which may be installed in utility penetrations 222. The interior of rear section 218 has gussets 224 to provide structural integrity between the middle section and rear section 218. The interior of hinged steering plate embodiment 200 continues to have an inner conical configuration 236 with the internal diameter getting smaller from the lead end 202 to the bulkhead 216.

Steering shell 240 has steering plates 250 which are attached to the exterior of the steering shell by "hinge" 252 over windows in the steering shell which are positioned to be overlying and adjacent to corresponding inflatable bags 128. While hinge 252 may have different configurations, it may be fashioned from a welded flat bar which attaches the steering plate 250 toe the steering shell 240. Upon inflation of an underlying and adjacent inflatable bag 128, the steering plate 250 pivots outwardly to react with the surrounding earth and affect a change in the direction of the hinged steering plate embodiment 200 of the steering head. Upon deflation of the underlying and adjacent inflatable bag, steering plate will no longer impose an radially force against the surrounding soil and thus no longer affect a change in direction.

FIGS. 9-12 depict the inner sleeve assembly 100 discussed above upon which a steering shell 340 has been disposed upon the middle section 110 resulting in the segmented steering shell embodiment 300. Segmented steering shell embodiment 300 has a lead end 302 which may have a front clearance horn. An outer relief band 304 is welded to lead end 302 along with an axially adjacent structural band 306 to provide the required structural integrity required for pipe ramming operations.

Segmented steering shell embodiment 300 has a bulkhead 316 which separates the steering shell 340 from rear section 318. A rear clearance horn 320 is attached at bulkhead 316, where the rear clearance horn helps to clear passage through the bore for the media lines which may be installed in utility penetrations 322. The interior of rear section 318 has gussets 324 to provide structural integrity between the middle section and rear section 318. The interior of segmented steering shell embodiment 300 continues to have an inner conical configuration 336 with the internal diameter getting smaller from the lead end 302 to the bulkhead 316.

Figure 12:
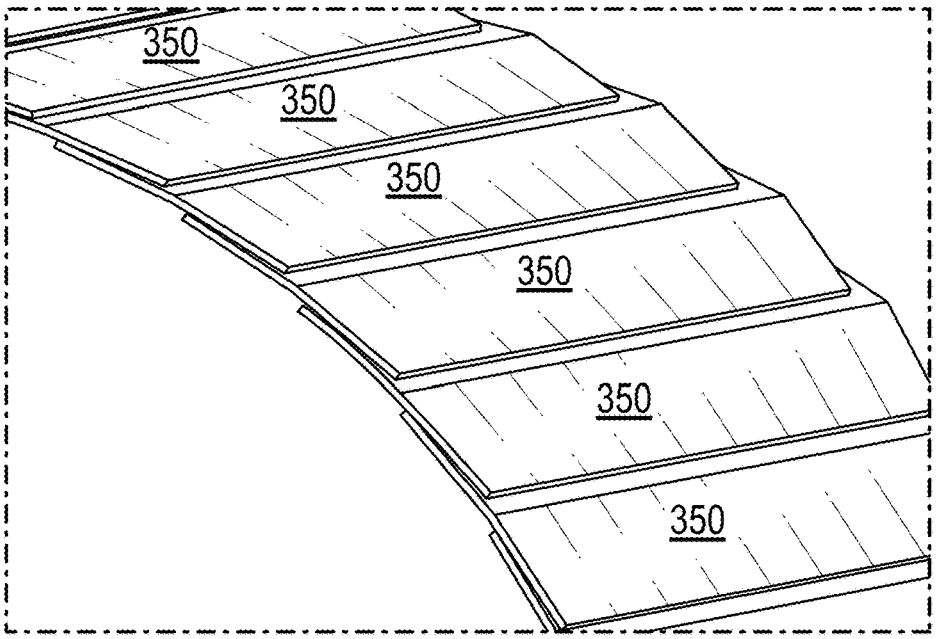
FIG. 12 shows a detailed view of the overlapping longitudinal plates of the segmented steering shell.

Steering shell 340 has a plurality of overlapping steering plates 350 which are connected together as shown in detail in FIG. 12, resulting in a "pleated skirt" configuration. This configuration allows the outwardly extension of those plates 350 which overlay an inflated inflatable bag 128, where lateral expansion of the inflatable bag is inhibited by centralizing rib 352 which directs bag expansion in a radially outward direction. Upon inflation of an underlying and adjacent inflatable bag 128, a portion of the steering plates 350 extend outwardly to react with the surrounding earth and affect a change in the direction of the segmented steering shell embodiment 300 of the steering head. Upon deflation of the underlying and adjacent inflatable bag, the portion of the steering plates 350 will no longer impose an radially force against the surrounding soil and thus no longer affect a change in direction.

Figure 13:
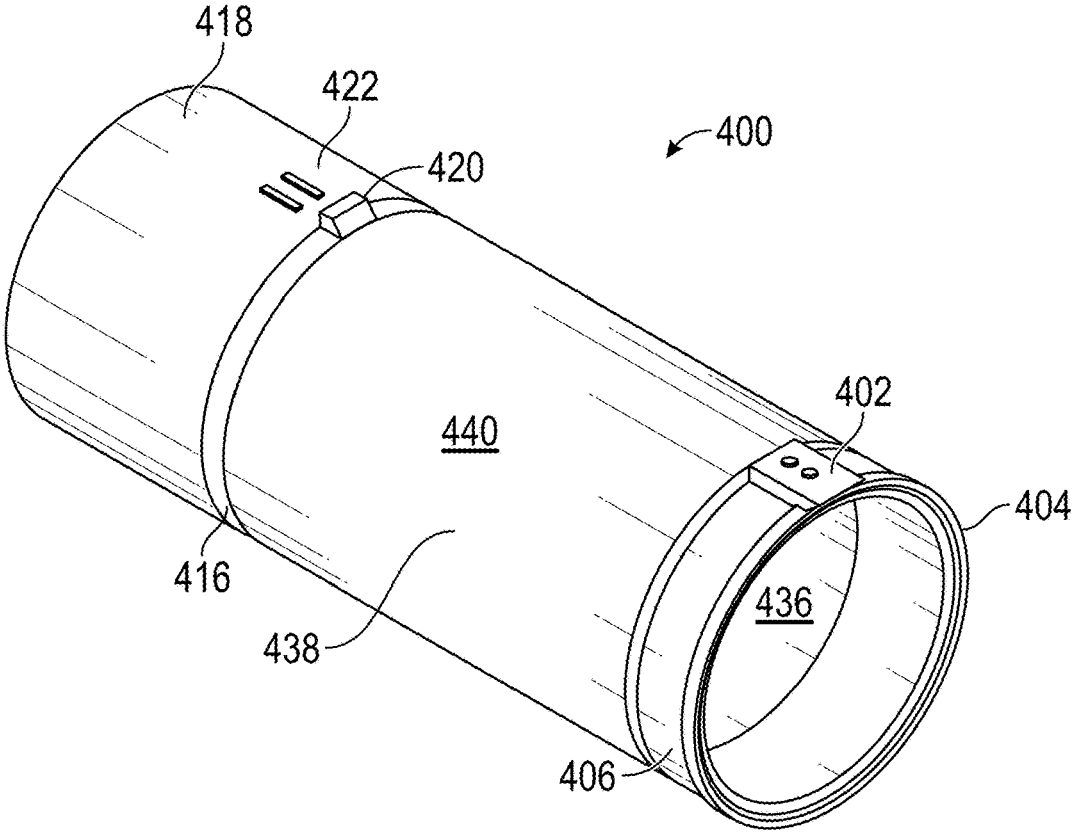
FIG. 13 shows a perspective frontal view of an embodiment of the disclosed steering head equipped with a deformable steering shell.
Figure 14:
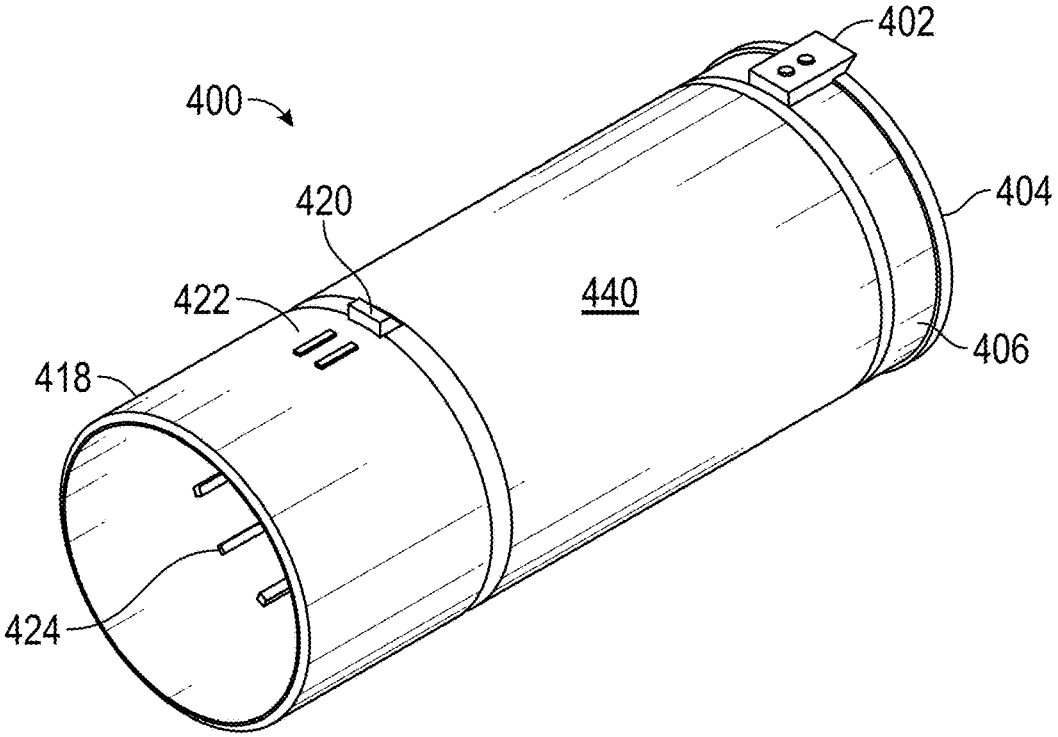
FIG. 14 shows a perspective rear view of an embodiment of the disclosed steering head equipped with a deformable steering shell.

FIGS. 13-14 depict the inner sleeve assembly 100 discussed above upon which a steering shell 440 has been disposed upon the middle section 110 resulting in the deformable steering shell embodiment 400. Deformable steering shell embodiment 400 has a lead end 402 which may have a front clearance horn. An outer relief band 404 is welded to lead end 402 along with an axially adjacent structural band 406 to provide the required structural integrity required for pipe ramming operations.

Deformable steering shell embodiment 400 has a bulkhead 416 which separates the steering shell 440 from rear section 418. A rear clearance horn 420 is attached at bulkhead 416, where the rear clearance horn helps to clear passage through the bore for the media lines which may be installed in utility penetrations 422. The interior of rear section 418 has gussets 424 to provide structural integrity between the middle section and rear section 418. The interior of segmented steering shell embodiment 400 continues to have an inner conical configuration 436 with the internal diameter getting smaller from the lead end 402 to the bulkhead 416.

The body of deformable steering shell 440 is made up a thin-walled ductile and flexible material which, upon imposition of an internal radially outward load, will have a portion of the body immediately overlying the load extend outwardly to react with the surrounding soil. Steering shell 400 may have structural features which provide additional flexibility, such as a longitudinal overlap 438 between adjacent sheets of material where there are no welds on the overlap, such that the overlapping portions are free to float over each other. Upon inflation of an underlying and adjacent inflatable bag 128, the portion of the steering shell 440 overlaying the inflatable bag extends outwardly to react with the surrounding earth and affect a change in the direction of the deformable steering shell embodiment. Upon deflation of the underlying and adjacent inflatable bag, the portion of the steering shell which had extended will no longer be urged outwardly by the inflatable bag against the surrounding soil and thus no longer affect a change in direction.

The material utilized for steering shell 400 may be fabricated from low carbon steel, such as A36, having a wall thickness of 0.375 inches or less.

Having thus described the preferred embodiment of the invention, what is claimed as new and desired to be protected by Letters Patent includes the following:

1. A steering head for a pipe ramming hammer bore system utilized for boring a borehole, the steering head comprising:

a casing member having an inside diameter, an exterior surface, an interior, a lead end and a tail end, the casing member comprising a rear section, a middle section, and a front section, wherein the middle section comprises a forward end and an aft end, wherein an internal diameter of the middle section decreases from a first diameter at the forward end to a smaller diameter at the aft end, wherein the lead end of the casing member is configured to be utilized in a boring operation;

a plurality of pocket sections defined on the exterior surface of the middle section, each pocket section disposed at a different circumferential position of the exterior surface;

an inflatable bag disposed within at least one of the pocket sections; and a shell member disposed on the casing member thereby enclosing the pocket sections and the inflatable bag, wherein at least a portion of the shell member is configured to extend radially outward upon an inflation of the inflatable bag.

2. The steering head of claim 1 wherein the inflatable bag is configured to cycle between an inflated state and a deflated state.

3. The steering head of claim 2 wherein a hose is connected to the inflatable bag, the hose providing a conduit for delivery of an inflation media to the inflatable bag.

4. The steering head of claim 3 wherein the hose provides a conduit for release of the inflation media from the inflatable bag.

5. The steering head of claim 3 wherein the inflation media comprises air.

6. The steering head of claim 1 wherein a bulkhead member is disposed between the rear section and the middle section.

7. The steering head of claim 6 wherein the bulkhead member comprises a plurality of hose penetrations through which a plurality of hoses extend through the hose penetrations to the pocket sections.

8. The steering head of claim 7 wherein the steering plate is attached to the shell member by a welded flat bar.

9. The steering head of claim 8 wherein the plurality of overlapping plate members are disposed in a parallel pleated configuration.

10. The steering head of claim 9 wherein the thin-walled deformable plate is configured as a cylindrical shell having a first edge of the thin-walled deformable plate overlapping a second edge of the thin-walled deformable plate.

11. The steering head of claim 1 wherein the shell member comprises a window at a position overlying and adjacent to the inflatable bag, wherein a steering plate has been disposed over the window, wherein the steering plate is configured to pivot outwardly upon inflation of the inflatable bag.

12. The steering head of claim 1 wherein the shell member comprises a plurality of overlapping plate members, wherein at least a portion of the overlapping plate members extend radially outward upon the inflation of the inflatable bag.

13. The steering head of claim 1 wherein the shell member comprises a thin-walled deformable plate, wherein at least a portion of the thin-walled deformable plate extends radially outward upon inflation of the inflatable bag.

14. The steering head of claim 1 wherein the inflatable bag is restrained from lateral expansion by a strut bar.

15. A steering head for a pipe ramming hammer bore system utilized for boring a borehole, the steering head comprising:

a casing member having an inside diameter, an exterior surface, an interior, a lead end and a tail end, wherein the lead end of the casing member is configured to be utilized in a boring operation;

a pocket section defined on the exterior surface;

an inflatable bag disposed within the pocket section; and a shell member disposed on the casing member thereby enclosing the pocket section and the inflatable bag, wherein the shell member comprises a thin-walled deformable plate, wherein at least a portion of the thin-walled deformable plate is configured to extend radially outward upon an inflation of the inflatable bag.

16. The steering head of claim 15 wherein the thin-walled deformable plate is configured as a cylindrical shell having a first edge of the thin-walled deformable plate overlapping a second edge of the thin-walled deformable plate.

17. A steering head for a pipe ramming hammer bore system utilized for boring a borehole, the steering head comprising:

a casing member having an inside diameter, an exterior surface, an interior, a lead end and a tail end, wherein the lead end of the casing member is configured to be utilized in a boring operation;

a pocket section defined on the exterior surface;

an inflatable bag disposed within the pocket section; and a shell member disposed on the casing member thereby enclosing the pocket section and the inflatable bag, wherein the shell member comprises a plurality of overlapping plate members disposed in a parallel pleated configuration, wherein at least a portion of the overlapping plate members extend radially outward upon an inflation of an inflatable bag.

* * * * *